US005927265A

United States Patent [19]

McKee et al.

[11] Patent Number: 5,927,265

[45] Date of Patent: Jul. 27, 1999

[54] RECYCLING COOKING OVEN WITH CATALYTIC CONVERTER

[75] Inventors: Philip R. McKee, Frisco; Earl R. Winkelmann, Garland, both of Tex.

[73] Assignee: TurboChef Technologies, Inc., Dallas, Tex.

[21] Appl. No.: 08/863,671

[22] Filed: May 27, 1997

[51] Int. Cl.[6] ..... F24C 15/32

[52] U.S. Cl. ..... 126/21 A; 219/400

[58] Field of Search ..... 219/400; 126/21 A

[56] References Cited

U.S. PATENT DOCUMENTS

| | | | |
|---|---|---|---|
| 2,658,742 | 11/1953 | Suter et al. | 219/400 |
| 2,795,054 | 6/1957 | Bowen | 219/400 |
| 3,364,912 | 1/1968 | Dills et al. | 219/400 |
| 3,785,778 | 1/1974 | Burstein | 219/400 |
| 3,828,760 | 8/1974 | Farber et al. . | |
| 4,138,220 | 2/1979 | Davies et al. . | |
| 4,437,451 | 3/1984 | Wysong . | |
| 4,460,332 | 7/1984 | Lawler et al. . | |
| 4,492,569 | 1/1985 | Vestergaard . | |
| 4,494,525 | 1/1985 | Albertsen . | |
| 4,648,378 | 3/1987 | Nishikawa . | |
| 5,166,487 | 11/1992 | Hurley et al. . | |

FOREIGN PATENT DOCUMENTS

| | | | |
|---|---|---|---|
| 2640684 | 9/1976 | Germany | 126/21 A |
| 56-44536 | 9/1979 | Japan | 126/21 A |

*Primary Examiner*—Carroll B. Dority
*Attorney, Agent, or Firm*—Amster, Rothstein & Ebenstein

[57] ABSTRACT

A recycling cooking oven providing a substantially closed environment, includes a thermal plenum for supplying a stream of hot air into a cooking chamber and for receiving a stream of hot air from the cooking chamber, the thermal plenum maintaining a reservoir of hot air therein. The cooking chamber of the oven supplies a stream of hot air into the thermal plenum and receives a stream of hot air from the thermal plenum, the cooking chamber cooking foods therein at least partially with a stream of hot air and such foods adding oxidizable components to the hot air of the stream. A blower and ducting cause the stream of hot air to circulate in substantially a continuous travel path including the thermal plenum and the cooking chamber. A catalytic converter is disposed in the travel path of the stream of hot air, downstream of the cooking chamber and upstream of the thermal plenum, for flamelessly oxidizing oxidizable components in the hot air of the stream leaving the cooking chamber, thereby both to remove them from the hot air of the stream and to release at least some additional heat energy into the hot air of the stream.

3 Claims, 4 Drawing Sheets

RECYCLING COOKING OVEN WITH CATALYTIC CONVERTER

BACKGROUND OF THE INVENTION

The present invention relates to a recycling cooking oven, and more particularly to a recycling cooking oven having a catalytic converter.

U.S. Pat. Nos. 5,254,823; 5,434,390; and 5,558,793 describe a recycling cooking oven which provides a substantially closed environment. Recycling cooking ovens typically utilize hot air to supply the heat energy for hot air impingement cooking. In a "hybrid" recycling cooking oven, both hot air and microwaves (from magnetrons) supply the energy for cooking. Such recycling cooking ovens are highly economical as the substantially closed environment means that the heat produced for the purposes of cooking is not needlessly vented to the atmosphere outside of the oven, but is used substantially exclusively for its intended purpose of cooking. Nonetheless, a combination of the inevitable heat losses from the oven to the ambient atmosphere (either through the oven walls or through the opening and closing of the cooking chamber door) plus the heat energy which is removed as part of the cooked foods taken out of the cooking chamber must be compensated for in some manner, traditionally at a substantial cost. Through proper insulation of the oven and careful design of the doorway through which food is introduced into and removed from the cooking chamber of the oven, these inevitable thermal losses may be minimized. However, recycling ovens are subject to unique problems not encountered, or only minimally encountered, in non-recycling ovens.

In a recycling oven, the hot air which moves over and around the food in the cooking chamber tends to carry with it small food particles which have become detached from the food as well as airborne grease and other particulates which have been created or released by the cooking process. The maintenance of clean cooking air (and, of course, a clean oven) is important for both sanitation and high quality food as well as to maximize the operating efficiency of the oven's cooking operation. For example the operating efficiency of the magnetrons used in microwave cooking is particularly sensitive to the cleanliness of the cooking air. Preferably the recycling oven is capable of cooking a wide variety of foods and is capable of replicating cooking methods ranging from broiling, baking, poaching and frying to roasting, toasting, steaming and grilling, etc. Especially when the oven is cooking partially cooked or raw meats, a large quantity of airborne greases are introduced into the cooking chamber and hence the cooking air. As a result, there may be a transfer of flavor between different foods which are being cooked in the same cooking chamber either simultaneously (whether or not the oven is a recycling one) or successively (i.e., in successive cooks of a recycling oven).

A conventional commercial oven (whether recycling or not) utilizes various methods to clear the air for re-use and to reduce the amount of airborne particles which would otherwise be deposited on the internal cooking surfaces of the cooking chamber and/or on the food items being cooked at that time or in subsequent cooking operations. The first method is a catch basket at the bottom of the cooking chamber which captures any large particles of food which break off during the cooking operation. The particles are held in the basket by gravity for easy removal during the daily cleaning operation. The second method is a metal filter screen through which all of the air which has been used in the cooking operation passes before it can be returned to the cooking chamber in a recycling oven or vented in a non-recycling oven. The metal filter screen mechanically removes airborne particles, including larger particles of grease, and deposits these impurities in a catch pan located beneath the filter screen. Both the filter screen and the catch pan can easily be removed from the oven for cleaning during the daily cleaning operation. The third method is the daily cleaning operation itself whereby all of the elements of the cooking chamber which come in contact with the air used in the cooking operation are cleaned in a prescribed manual operation.

Nonetheless, even the combination of these air clearing techniques has not proven to be entirely satisfactory. Accordingly, current commercial ovens—even the recycling ones—are frequently used in conjunction with an overhead hood ventilation system to capture and ventilate any amounts of airborne grease which are discharged by the oven in high-grease operations. Many municipalities and their regulatory agencies require these types of overhead ventilation systems to assure the safety of the cooking operation (as accumulated deposits of grease can be a fire hazard) and the quality of the food cooked. Most of these types of overhead ventilation systems are permanent installations, which are both costly and cumbersome.

Currently the fastest-growing segment of the "fast food" industry is the so-called "non-traditional" site. Many of the large national chains have exhausted the availability of high-traffic real estate sites for either free-standing buildings or in-line storefront locations. In addition, as real estate has become more expensive on a square foot basis, the pressure to shrink the size of restaurant kitchens has been intense. Nowhere is this more true than in the "non-traditional" location where total operating space is reduced from an average of 2000–40000 square feet to 400–800 square feet. These non-traditional locations are often within larger buildings such as airports, mass merchandisers, and convenience stores, where access to outside ventilation is even more expensive than in a traditional restaurant site. Clearly, the need is great for an advanced air clearing system which obviates the necessity for an overhead hood ventilation system.

Accordingly, it is an object of the present invention to provide a recycling oven which requires the addition of only a minimum of heat energy for continued cooking operation.

Another object is to provide such an oven wherein there is a minimum of flavor and odor transfer between the different foods in simultaneous or consecutive cooks.

A further object is to provide such an oven which does not require an overhead hood ventilation system.

It is also an object to provide such an oven which requires a minimum of manual labor during the daily cleaning operation.

SUMMARY OF THE INVENTION

It has now been found that the above and related objects of the present invention are obtained in a recycling cooking oven providing a substantially closed environment. The oven includes both a thermal plenum for supplying a stream of hot air into a cooking chamber and for receiving a stream of hot air from the cooking chamber, and a cooking chamber for supplying a stream of hot air into the thermal plenum and for receiving a stream of hot air from the thermal plenum. The thermal plenum maintains a reservoir of hot air therein, and the cooking chamber cooks food therein at least partially with a stream of hot air, such foods adding oxidizable components to the hot air. The oven additionally includes means for causing the stream of hot air to circulate in substantially a continuous travel path including the thermal plenum and the cooking chamber, and a catalytic converter disposed in the travel path of the stream of hot air, downstream of the cooking chamber and upstream of the thermal plenum, for flamelessly oxidizing oxidizable components in the hot air of the stream leaving the cooking chamber, thereby both to remove them from the hot air of the stream and to release at least some additional heat energy into the hot air of the stream.

In a preferred embodiment the thermal plenum maintains the reservoir of hot air at at least 570° F., and the catalytic converter has an inlet temperature of at least 475° F. The light-off temperature is preferably 475–550° F. The oxidizable components include grease, fats, oils and like hydrocarbons produced by cooking food in the cooking chamber, and the oxidizable components are oxidizable essentially to carbon dioxide and water.

BRIEF DESCRIPTION OF THE DRAWING

The above and related objects, features, and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
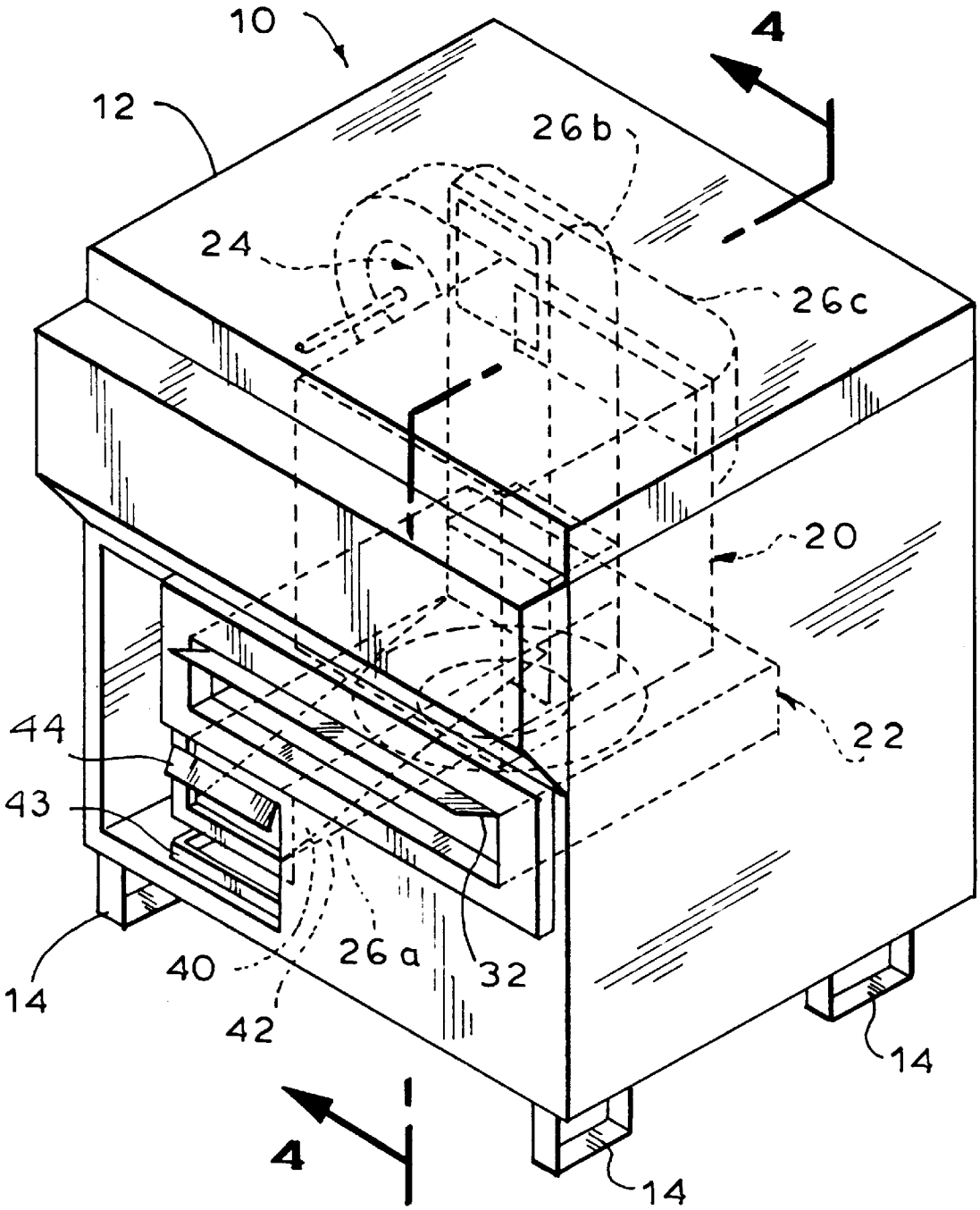
FIG. 1 is an isometric view of an oven according to the present invention.
Figure 2:
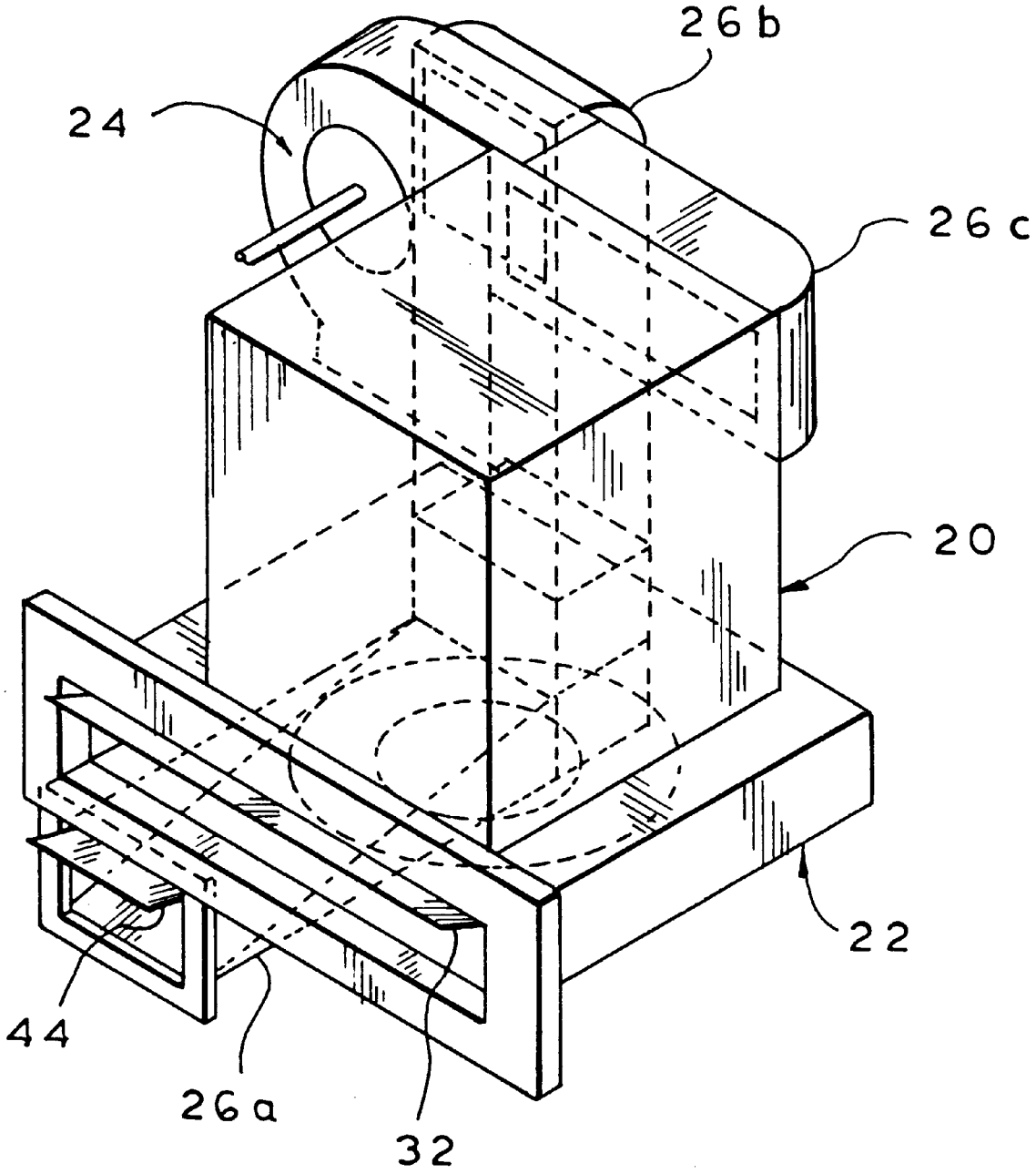
FIG. 2 is an isometric view similar to FIG. 1, but without the oven housing.
Figure 3:
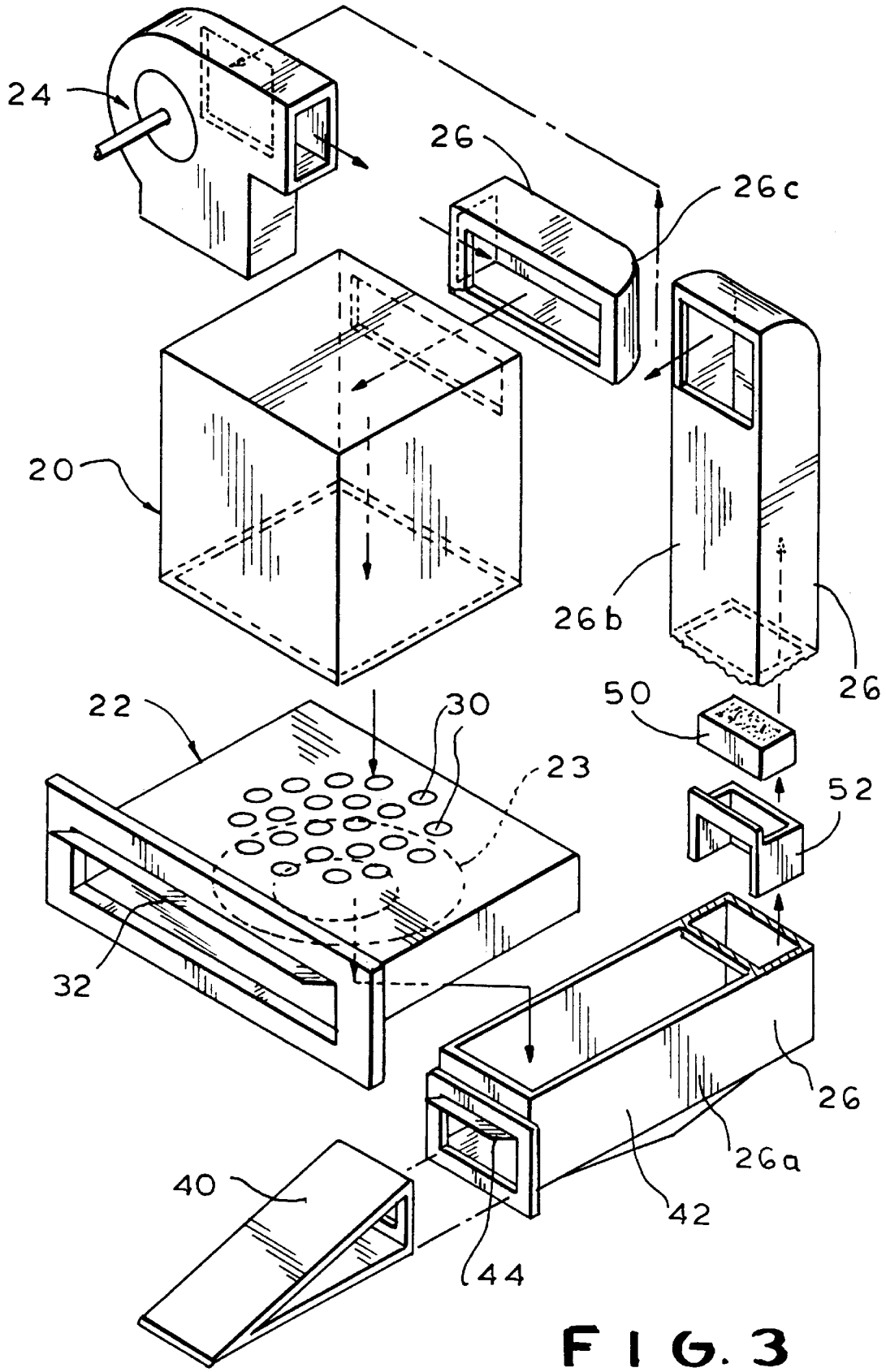
FIG. 3 is an exploded schematic view of the oven without the oven housing.
Figure 4:
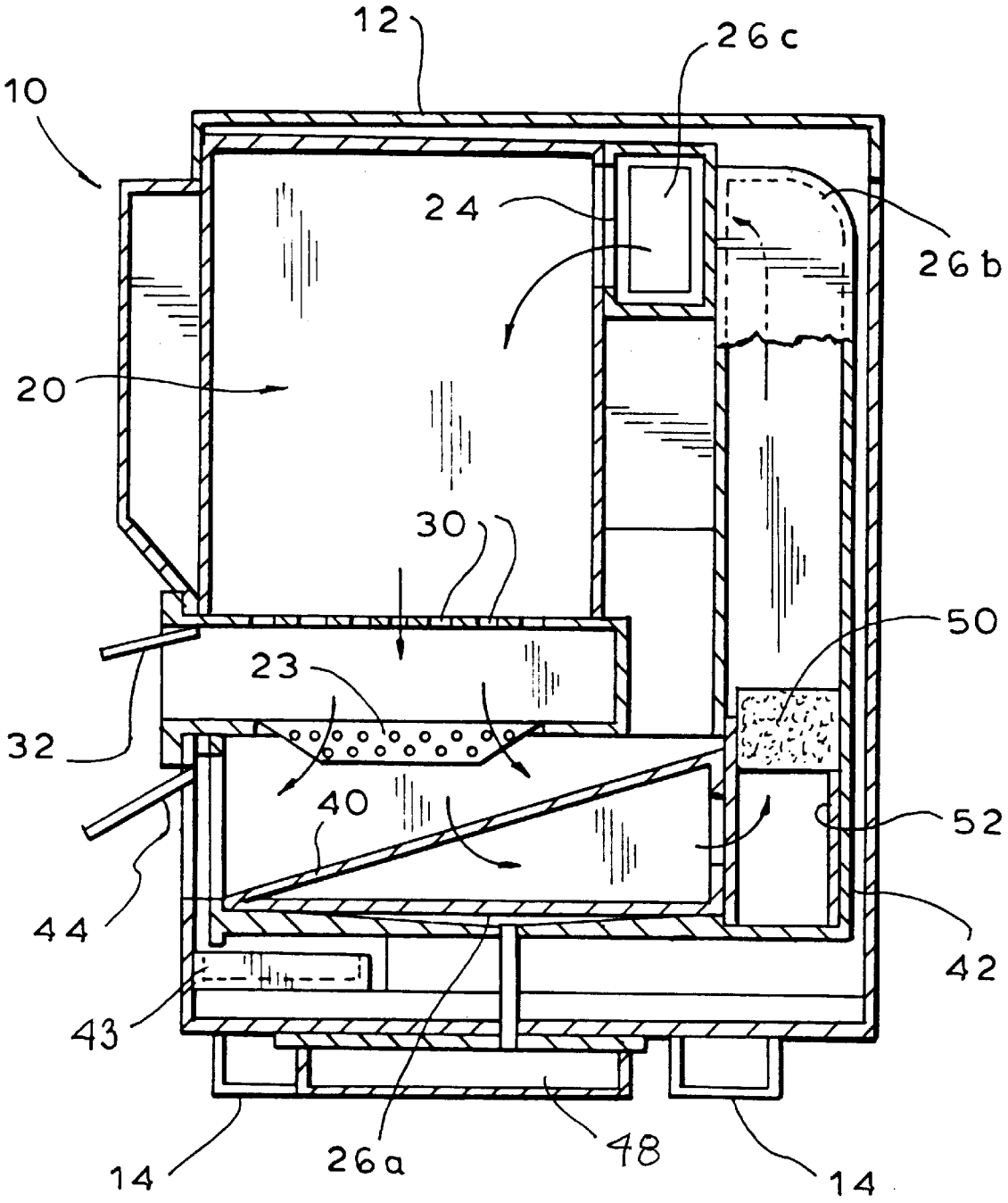
FIG. 4 is a sectional view of the oven taken along the line 4—4 of FIG. 1.

Referring now to the drawing and in particular to FIG. 1 thereof, therein illustrated is a recycling oven according to the present invention, generally designated by the reference numeral 10. The functioning parts of the oven 10 are disposed in a housing 12 supported by feet 14. The functioning parts are illustrated in FIG. 2 without the housing and are schematically illustrated in the exploded view of FIG. 3, wherein the arrows represent the travel path of the stream of hot air.

In its conventional aspects, the oven 10 comprises a thermal plenum generally designated 20, a cooking chamber generally designated 22, and means 24, 26 for causing the stream of hot air to circulate in a substantially continuous travel path (illustrated by the arrows of FIG. 3) including the thermal plenum 20 and cooking chamber 22. More particularly, the circulating means 24, 26 includes a motor-driven blower 24 (the motor not being shown) and ducting 26.

More particularly, the thermal plenum 20 is configured and dimensioned to maintain a reservoir of hot air therein of adequate volume such that, once the oven has been warmed-up, the plenum 20 has sufficient hot air therein to immediately commence the process of cooking whatever foods are placed in the cooking chamber 22. To this end, the thermal plenum 20 contains heating means (not shown) such as electrical heating elements (either with or without a phase-change reservoir of heat). A temperature sensor (not shown) is preferably disposed within the thermal plenum 20 to regulate the heating means and ensure that the reservoir of hot air is maintained at an appropriate temperature. The thermal plenum 20 preferably maintains the reservoir of hot air at at least 570° F. for reasons which will become apparent hereinafter.

The plenum 20 supplies a stream of hot air into the cooking chamber 22 via a series of perforations, manifolds, or the like, as necessary to provide hot air impingement cooking of the food within the cooking chamber 22, and receives a stream of hot air from the cooking chamber 22 via the ducting 26, the blower 24, etc.

The cooking chamber 22, as earlier noted, supplies a stream of hot air into the thermal plenum 20 via the ducting 26, blower 24 and the like, and receives a stream of hot air from the thermal plenum 20 via a series of perforations, manifolds 30 or the like. The cooking chamber cooks the foods therein (not shown) at least partially with the stream of hot air and, in turn, the foods undergoing the cooking process add oxidizable components to the hot air of the stream. Depending upon the particular foods being cooked in the cooking chamber, the oxidizable components released from or formed by the foods include grease, fats, oils and like hydrocarbons produced by or resulting from the cooking of the foods in the cooking chamber 22. The cooking chamber 22 includes an oven housing door 32 which may be opened for the placement of foods within the cooking chamber 22 and the removal of cooked foods therefrom.

A motor-driven blower 24, preferably of variable speed, causes the stream of hot air to circulate in substantially a continuous travel path including the thermal plenum 20, the cooking chamber 22 and the various elements of ducting 26.

The ducting 26 includes a filter mechanism 26*a*, a vertical duct 26*b* leading from the filter mechanism 26*a* to the blower 24, and a horizontal duct 26*c* which receives the hot air from the blower 24 and introduces it into the thermal plenum 20. Just above the filter mechanism 26*a* the bottom surface of the cooking chamber 22 has a large circular void. A donut-shaped catch basket 23 is disposed in the void at the bottom of the cooking chamber 22 and captures any large particles of food which break off during the cooking operation, with gravity holding the large particles of food in the catch basket for easy removal during the daily cleaning operation. The cooking disc (not shown), which supports the food product during cooking, is mounted on the oven housing door 32 for movement therewith and sits atop this catch basket 23 during cooking.

The filter mechanism 26*a* includes an inclined metal filter screen 40 which is disposed in a filter housing 42. All of the hot air which has been used in the cooking operation passes through the screen 40. This screen 40 mechanically removes airborne particles, including larger particles of grease, and deposits these in a catch pan 43 located therebelow. The catch pan 43 is preferably located just below the interface of the filter housing 42 and a filter door 44 enabling access to the filter housing 42, thereby to capture any seepage from the interface, especially when the door 44 is open. When the housing door 44 is opened, it enables passage of the filter housing 42 (including the screen 40) through the doorway. Both the filter screen 40 and the catch pan 43 are easily removed from the oven 10 during the daily cleaning operation.

The interior oven surface (below the filter housing 42) is preferably inclined towards the center and provided with a waste tube 46 which transfers any liquid waste accumulating in the center towards a removable pan 48 disposed outside the housing 12 (e.g., slidably attached to the bottom exterior surface of the oven).

The aforementioned three U.S. patents are hereby incorporated by reference in their entirety. As recycling ovens of the type described are well-known to those skilled in the art—e.g., from the aforementioned three U.S. patents—it is not deemed necessary to provide additional details thereof. It will be appreciated, however, that the aforementioned conventional components of the present invention are similar to those described in conjunction with the aforementioned U.S. patents except that the sequence and relative locations of the various components have been modified somewhat.

It will be appreciated that, while the embodiment illustrated relies exclusively upon hot air impingement cooking, a hybrid oven according to the present invention may rely as well on microwave cooking. Where appropriate, the center of the donut-shaped catch basket 23 may be capped off in a manner which permits microwave transmission therethrough.

Turning now to the novel aspects of the present invention, the oven 10 of the present invention includes a catalytic conversion unit or converter 50 and a holder 52 therefor, both being removably disposed or adjacent in the rear of the filter housing 42. The catalytic converter 50 is disposed in the travel path of the hot air stream downstream of the mechanical filter 40.

The holder 52 fits into the rear of filter housing 42 and supports the converter 50, preferably at least partially in vertical duct 26*b* leading to the blower 24. To periodically clean the converter 50, the mechanical filter screen 40 is removed from its housing 42, the converter 50 is pushed upwardly all the way into vertical duct 26*b*, the filter housing 42 and converter holder 52 are removed through a passageway, and then the converter 50 is pulled down and removed through the same passageway.

The oxidation catalyst 50 acts on a combustion mixture in much the same way that the spark or flame ignition does, but at a lower temperature and without a flame. Thus, to complete combustion both ignition or "light-off" and sufficient oxygen must be present. However, an important difference between catalytic oxidation and ignition firing is that the former can cause total combustion of very low concentrations of combustible material, which could not sustain combustion in the absence of the catalyst or very high temperatures. The reason is that the combustion reaction actually takes place at the surface of the catalyst.

When combustible substances made from carbon, hydrogen, and oxygen react with oxygen in the air, they produce carbon dioxide and water along with a predictable amount of heat. The heat released (that is, the exothermic heat of reaction) causes the gas temperature to rise within the converter. The greater the air/fuel ratio, the greater the amount of heat released. For most applications it is recommended that the air/fuel ratio be adjusted to give a temperature rise between the outlet and inlet of the converter no greater than 200–300° F.

For typical volatile hydrocarbons and a converter having an ignition or light-off temperature of 475–550° F., the converter inlet should be at 475° F., resulting in the active catalytic surface having an operating temperature of 900-1,100° F. for most normal designs. The converter outlet is typically at 650–850° F. The catalytic converter causes the combustion of the airborne grease from cooking to occur between 475°–550° F., which includes the normal operating range of the oven (with the temperature sensor in the thermal plenum 20 set for 570° F. and the cook temperature being 520° F.). In the absence of a catalyst, airborne grease will combust at temperatures of 700–800° F., which is significantly higher than the temperature at which an oven typically operates, i.e., 475–550° F. The catalyst materials typically function most effectively for this application within a temperature range of 475° F. to 550° F. Normal grease and odor-laden air streams emanating from cooking operations are effectively oxidized at a temperature of about 500° F.

The conversion of airborne grease to heat energy is approximately 20% for each pass of the circulating hot air stream through the converter 50. Since the volume of air utilized by the oven is re-circulated rapidly and frequently, successive and cumulative conversion allows for a continual and complete clean-up of the air stream.

Considering now the catalyst and catalyst substrate structure which is useful in the practice of the invention, it is to be understood that catalysts and substrate structures other than those specifically described and illustrated herein can be utilized without departing from the scope of the invention. Various catalysts capable of flameless oxidation of greases, oils, etc. and the fumes and odors characteristic thereof can be used, different catalysts having different operating temperature ranges and being most effective for different hydrocarbons at differing sub-ranges within the operating temperature ranges thereof.

A preferred catalytic system comprises a honey-comb substrate of refractory material which is coated with a platinum-containing catalyst. The honey-comb substrate offers a large surface area for coating by the catalyst and, thus, a large effective surface area for contact between the catalyst and the organic materials which are to be oxidized. Catalysts suitable for coating the honey-comb substrate include platinum-based catalysts such as tetramine platinum nitrate $(NH_3)_4Pt(NO_3)_2$, mixtures of chloroplatinic acid, alumina and dextrose, or a solution of tetramine platinum nitrate of the formula $(NH_3)_4Pt(NO_3)_2$. Mixtures of a platinum compound with a compound of another additive metal, such as palladium, rhodium, ruthenium, iridium, etc., in various ratios, usually with the platinum compound predominating, are also useful in the practice of this invention. The catalyst material is deposited on the surfaces of the substrate, usually by dipping of the substrate into a dispersion or solution thereof and then drying or heat treating the coated substrate to fix the catalyst material on the substrate. The honey-comb substrate can be formed of Torvex, a ceramic made by the DuPont Corporation, or of similar materials manufactured by Dow Corning, Inc. or Minnesota Mining and Manufacturing, Inc., etc. Catalyst-coated granules of a silica/alumina substrate material are also useful as are other well-known refractory metal oxides. Other catalytic methods include the use of pellets, etc.

An especially preferred catalytic converter formed of a calcined alumina substrate with platinum on a stainless steel support is available under the trade name CAMET OXIDATION CONVERTER (from W. R. Grace & Co. of Hiram, Ohio 44234, now Engelhard Corporation of Iselin, N.J.). Typical densities for oxidation are 100–350, preferably 140, cells/inch$^2$ and a preferred catalyst density is 30 g/ft$^3$. Another especially preferred catalytic converter is made of corrugated ferritic stainless-steel foil arranged in a design that promotes contacting with the hot air stream. The foil is coated with an aluminum oxide washcoat containing various metal oxide promoters and small amounts of an active catalyst from the platinum group—that is, platinum, palladium, or rhodium.

Poisoning of the catalytic sites due to chemical reactions with the catalyst and the masking of sites (by materials which cover but do not combine chemically with the sites) may be dealt with in the normal manner, typically using various cleaning or replacement techniques.

While the basic operation of a recycling oven is efficient in its utilization of electrical energy, the addition of a relatively free secondary source of energy for available heat (that is, the catalytic converter) makes it even more efficient. The free secondary source of energy reduces the heating demand on the heat reservoir and enables the pre-set thermal plenum temperatures to be maintained at a lower operating cost.

The efficiency of the catalytic conversion process vastly reduces the amount of airborne grease—and accompanying odor—which is re-circulated over food products cooked simultaneously or sequentially. This allows the operator to cook a wider variety of food products, each maintaining its distinctive flavor, with a much higher production throughput than conventional cooking methods, which require similar foods to be segregated and cooked separately. For example, according to the present invention, a delicate puff pastry can be baked in the same or a subsequent cooking sequence as a raw fish fillet. As another example, cooked pepperoni pizza has a distinctive aroma associated with the pepperoni that can linger in an oven due to the presence of grease in circulating air. This lingering aroma can be transferred to subsequently cooked food products, such as cheese pizza, which is particularly sensitive to odor absorption. Nonetheless, the efficacy of the catalytic conversion process enables such foods (i.e., pepperoni pizza and cheese pizza) to be cooked sequentially.

The present invention not only minimizes heat energy costs and provides superior cooking of a variety of different food products (either simultaneously or sequentially), but it also reduces the amount of manual labor required in the daily cleaning operation. The catalytic combustion process removes a large amount of airborne grease (and converts it to heat energy) so that it is not deposited on the surfaces of the cooking chamber and the mechanical filters. Since grease is the most insidious foreign element produced in the cooking process, its removal substantially reduces the time (and cost) required for cleaning the oven by hand in the daily maintenance procedures.

Finally, because the present invention greatly reduces the amount of airborne grease which is discharged into the air in a restaurant kitchen, it eliminates the need for an overhead hood ventilation system and minimizes the noticeable and often unpleasant airborne grease odor wafting to the customers, especially in "open kitchen" configurations where customer traffic comes into direct contact with the cooking area.

To summarize, the present invention provides a recycling oven which requires the addition of only a minimum of heat energy for continued cooking operation, permits different foods to be cooked in simultaneous or consecutive cooks with only a minimum of flavor and odor transfer between the different foods. Further, the oven does not require an overhead hood ventilation system and minimizes the amount of manual labor required for the daily cleaning operation.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A recycling cooking oven for cooking at least in part by hot air impingement and providing a substantially closed environment, comprising:

(A) a cooking chamber for receiving a stream of hot air from a thermal plenum via a plurality of openings in a top of said cooking chamber, said cooking chamber cooking food therein at least partially with streams of hot air from the plurality of openings and such foods adding oxidizable components to the hot air;

(B) a thermal plenum located upstream of said cooking chamber and including a heating means for supplying hot air downwardly into said cooking chamber via said plurality of openings;

(C) means for causing the stream of hot air to circulate in substantially a continuous travel path including said thermal plenum, said plurality of openings and said cooking chamber; and (D) a catalytic converter disposed in said continuous travel path of the stream of hot air for flamelessly oxidizing oxidizable components in the hot air of the stream leaving said cooking chamber, thereby both to remove them from the hot air of the stream and to release at least some additional heat energy into the hot air of the stream.

2. The oven of claim 1 including means for maintaining said thermal plenum at at least 570° F.; and an inlet temperature of said catalytic converter at at least 475° F. and said catalytic converter being characterized by a light-off temperature of 475–550° F., said catalytic converter flamelessly oxidizing oxidizable components in the hot air of the stream leaving said cooking chamber essentially to carbon dioxide and water.

3. The oven of claim 1 wherein said catalytic converter is disposed downstream of said cooking chamber and upstream of said thermal plenum.

* * * * *